United States Patent [19]

Stone

[11] 4,198,05

[45] Apr. 15, 198

[54] AUTOMATIC GOLF BALL TEEING DEVICE

[76] Inventor: Arthur Stone, Apt. 504, 3625 N. Country Club Dr., N. Miami Beach, Fla. 33180

[21] Appl. No.: 927,918

[22] Filed: Jul. 25, 1978

Related U.S. Application Data

[62] Division of Ser. No. 855,666, Nov. 29, 1977, Pat. No. 4,146,232.

[51] Int. Cl.[2] ..... A63B 57/00

[52] U.S. Cl. ..... 273/201; 273/176 F; 273/182 R

[58] Field of Search ..... 273/201, 33, 182, 176 A; 124/49, 50

[56] References Cited

U.S. PATENT DOCUMENTS

| | | | |
|---|---|---|---|
| 1,972,894 | 9/1934 | Loeb | 273/201 |
| 2,390,998 | 12/1945 | Gale | 273/201 |
| 3,037,776 | 6/1962 | Younce | 273/182 |
| 3,298,694 | 1/1967 | Turneau | 273/201 |
| 3,448,985 | 6/1969 | Scott | 273/201 |
| 3,519,275 | 7/1970 | Meierjohan | 273/201 |
| 3,533,631 | 10/1970 | Hladek | 273/201 |
| 3,599,980 | 8/1971 | Harmond | 273/176 A |
| 3,599,983 | 7/1969 | Melton | 273/201 |
| 3,778,067 | 12/1973 | Gentiluomo | 273/201 |
| 3,966,213 | 6/1976 | Bailey | 273/201 |

*Primary Examiner*—Richard C. Pinkham

*Assistant Examiner*—T. Brown

*Attorney, Agent, or Firm*—Lane, Aitken & Ziems

[57] ABSTRACT

An automatic golf ball teeing apparatus comprised of chamber placed beneath the ground. A hollow piston mounted in the chamber for vertical movement b tween first and second positions. Mounted within tl piston is a pair of vertically spaced apart members; eac of the members are movable relative to the pisto mounted between the members is a first coil spring an mounted between the lower member and the lower en of the piston is a second coil spring. A sleeve is mounte around the piston and is movable relative thereto an extends above the piston when the piston is in a lowere position. The sleeve is connected to the lower membe such that the sleeve and lower member move togethe relative to the piston. A stop element is located at th top of the chamber for engaging the sleeve as the pisto moves towards the second position for stopping mov ment of the sleeve relative to the piston, the second co spring urging the sleeve back to its initial position as th piston is moved to its first position. A ball tee mounted on the upper end of the piston for receiving ball when the piston is in the first position. A ball suppl element of the apparatus is provided to automaticall deposit a ball on the tee when the piston is in its fir position, the supply of balls being automatically cut o by the sleeve when the piston is in its second positior

6 Claims, 6 Drawing Figures

AUTOMATIC GOLF BALL TEEING DEVICE

This is a division, of application Ser. No. 855,666, filed Nov. 29, 1977, (U.S. Pat. No. 4,146,232).

BACKGROUND OF THE INVENTION

This invention relates to golf driving ranges and, more particularly, to a device for automatically teeing-up a golf ball for use in connection with driving ranges.

Golf driving ranges traditionally have required large pieces of land in order to provide sufficient room for long-distance driving. With the cost of land increasing and a greater demand for such driving ranges in high population areas, there is a need to develop a driving range which can be operated indoors or on a small piece of land.

In order to maximize efficient use of time while using a driving range, it is desirable to provide an automatic golf ball teeing device which can in a matter of seconds tee up a second ball after one is driven. In addition to reducing strain on people with back problems, such a device allows more practice in a given period of time. It also would be advantageous to accommodate chip shots as well as drives so that the golfer can work on his total game and not just driving alone.

SUMMARY OF THE INVENTION

In accordance with the invention, a golf ball driving range is provided which utilizes a small area and includes a target at which the golfer can aim his shots. A hopper is located beneath the target for receiving balls bouncing off the target. The hopper contains an opening at the bottom of a sloped floor for receiving the balls, the opening being connected to a conduit which returns the balls to an automatic teeing device either by gravity or by means of a fan.

One embodiment of the automatic teeing device includes an arm at the other end of the conduit, the arm having a ball receiving pocket into which a ball can roll from the conduit. The arm is pivotally mounted and connected to a motor-driven crank through a connecting rod, such that when the motor rotates the arm will move from the ball receiving position downward to a position where the ball will roll along the arm and be deposited onto a tee. The connecting rod includes a spring member positioned so that as the crank is moving and the arm is in the ball depositing position, the arm will hesitate and remain in that position long enough to allow the ball to roll along the arm and be deposited on the tee before the arm is automatically retracted. The arm can also include a manually adjustable telescoping portion so that if the golfer wants to practice chip shots instead of the tee shots, the arm can be lengthened to deposit the ball on the ground or other surface suitable for chip shots.

The driving range can include a switch located in a number of positions for automatically activating the teeing device such as, for example, at the opening in the hopper or at some point along the conduit. Further, a manually operated switch can be located near the tee so that a ball can be teed up by touching the switch with a club or foot.

A novel switch can be provided which will automatically be activated when the ball is hit off the tee. The switch includes a rotatable bar connected to the tee and located beneath the driving surface such that when the ball is driven the force of the club hitting the ball and/or tee will move the tee forward and cause the bar rotate. This, in turn, causes a member connected at c end of the bar to rotate and contact one end of an shaped member pivotally mounted at its corner. T other end of the L-shaped member will engage plunger connected to a switch and activate the devi The rotatable bar includes a counterweight for autom ically returning the tee to its upright position after t plunger has been engaged by the L-shaped member.

A second embodiment of an automatic teeing devi also utilizes a rod and crank mechanism, but instead having an arm located above the ground which is rot able between ball receiving and depositing positions piston is provided which moves up and down in opening or recess in the ground. When the piston is its lower-most position a ball can roll from the cond onto the tee connected at the top of the piston. T piston can move upward and raise the ball above t ground into the driving position. The stroke of t piston can be adjusted to accommodate chip shots well as drives. The piston can include an outer slee movably independent of the piston to prevent ad tional balls from moving into the path of the piston a moves upward. The piston has a spring inside to allc the tee to retract into the piston should someone step the tee when it projects above the ground surface.

BRIEF DESCRIPTION OF THE DRAWINGS

For a better understanding of the invention, referen may be had to the following description of several pr ferred embodiments of the invention taken in conjur tion with the accompanying drawings in which.

DETAILED DESCRIPTION OF SEVERAL PREFERRED EMBODIMENTS

Figure 1:
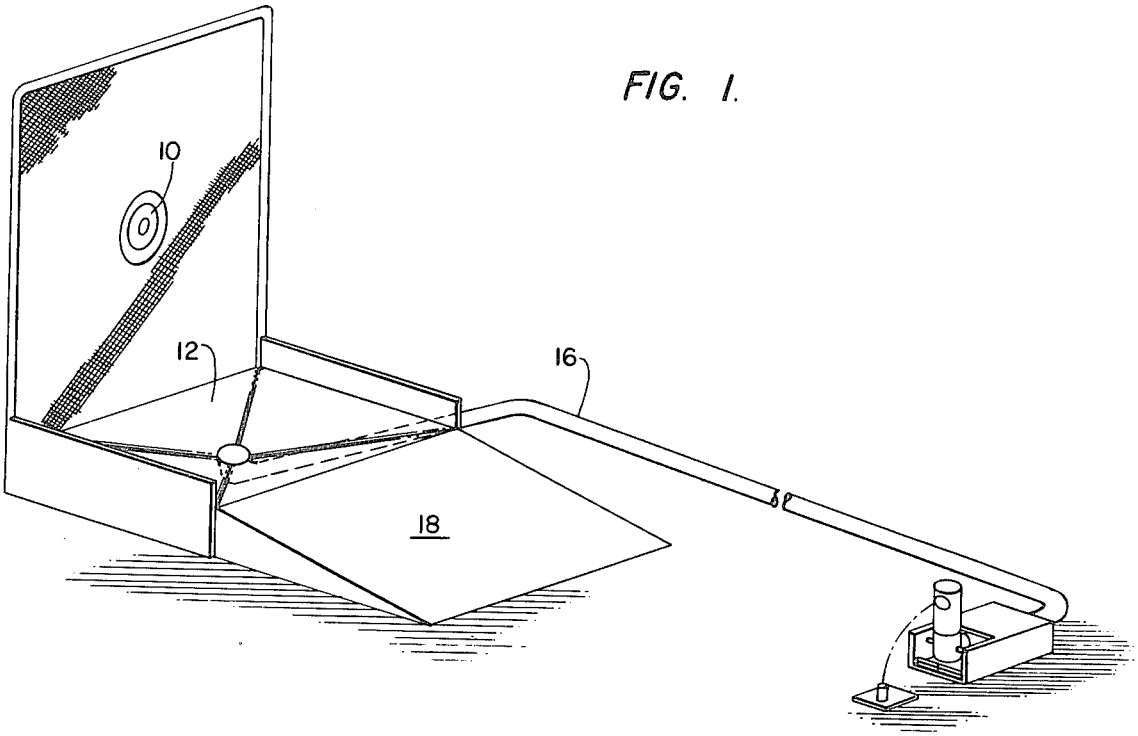
FIG. 1 is a perspective view of a driving range which an automatic teeing device can be used.

A driving range of the type in which the inventi automatic teeing devices can be used is shown general in FIG. 1. The driving range includes a target 10 whi can be formed of or mounted on a suitable resilie cushioned-type material to prevent the golf ball frc rebounding back toward the golfer. A hopper 12 located below the target 10 and slopes downward away from the target 10 towards an opening 14 whi leads to a conduit 16. A ramp 18 slopes upwardly frc the ground to the front portion of the hopper so tl balls which are hit short of the hopper will bounce roll into the hopper 12. Alternatively, the opening can be located directly beneath the target or in the frc of the hopper 12.

Any type of suitable netting or mesh material can used to surround the driving range to prevent golf ba hit inaccurately from leaving the driving range. T conduit 16 is used to return the balls back to the au ıtic teeing device either by gravity or by means of a ›wer or fan.

Figure 2:
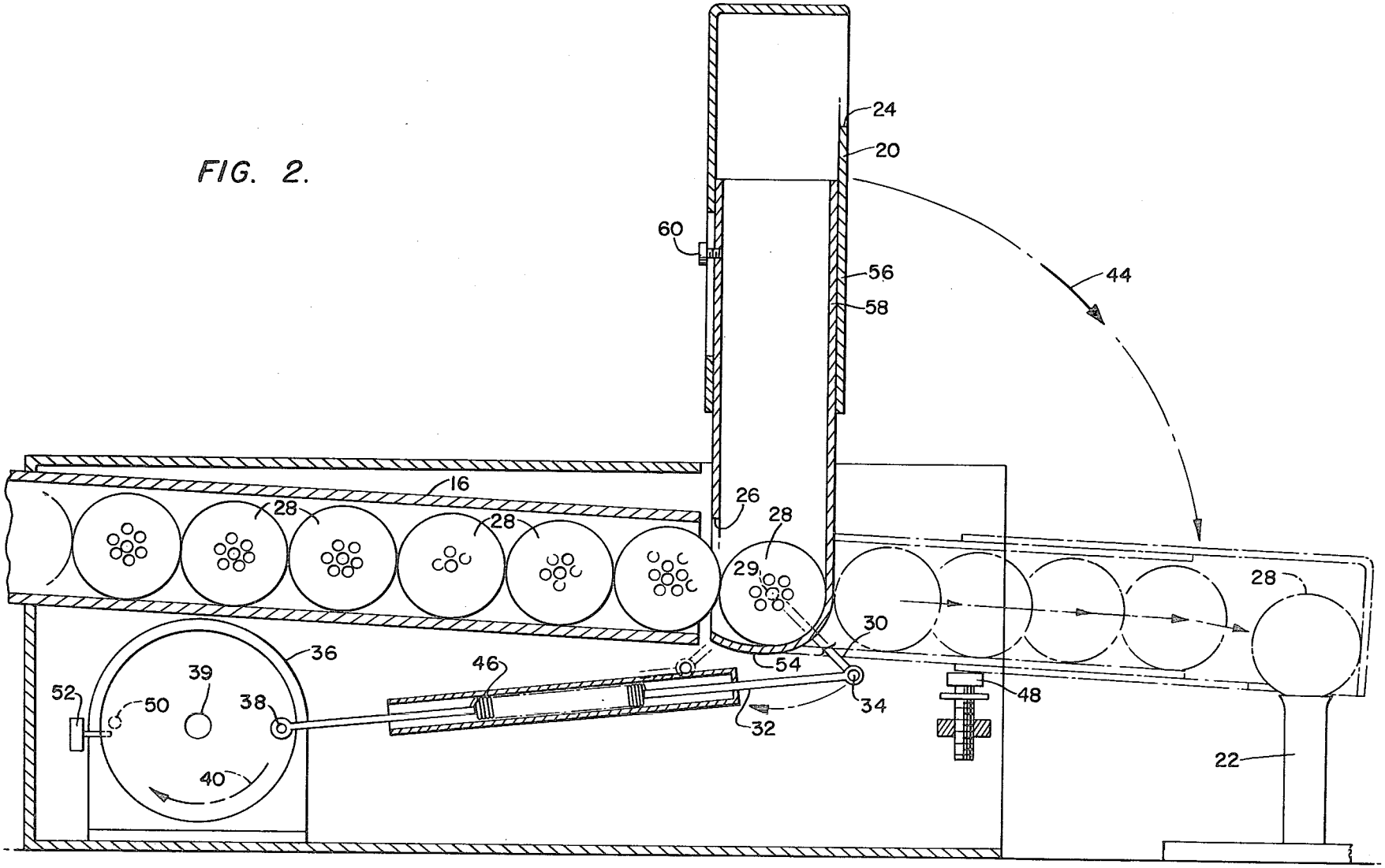
FIG. 2 is a side plan view of a movable arm type automatic teeing device.

One embodiment of the automatic teeing device is ›wn in FIG. 2, which includes a movable arm 20 for positing golf balls one at a time on a tee 22. In this ıbodiment, the conduit 16 and components of the tomatic teeing device are all located above the sur-:e from which the ball is driven.

The movable arm 20 can be formed of any suitable ›e of rigid material such as metal or plastic and in-ıdes an opening 24 located at its outer end through ıich a golf ball will roll onto the tee 22. The other end the conduit 20 includes an opening 26 through which golf ball is received. As can be seen from FIG. 2, a ırality of golf balls 28 are located in the conduit 16. hen the arm 20 is in the upright position shown in G. 2, the forward-most ball will roll into the arm 20 :ough the opening 26.

The arm 20 is pivotally mounted by any suitable :ans at a pivot point 29. A rod 30 is rigidly connected the arm 20 at the pivot point 29 for moving the arm between the position shown by the solid lines in FIG. ınd the position shown by the dotted lines. One end of connecting rod 32 is pivotally connected at pivot int 34 to the rod 30, the other end being connected to :rank 36 at pivot point 38. The crank 36 is connected a shaft 39 which is rotated by means of any suitable ›e of motion such as, for example, a 7 RPM, 115 volt ⊃, magnetic gear brake motor. As the motor causes : crank 36 to rotate in the direction of the arrow licated by reference numeral 40, the connecting rod will pull the rod 30 and cause the arm 20 to move wnward in the direction of the arrow designated by 'erence numeral 44 to the position shown by the dot-l lines.

When the arm 20 reaches the position shown by the tted lines, the ball will roll down the arm 20, as ›wn by the dotted lines, and be deposited on the tee . It has been found, however, that the arm 20 must be owed to hesitate a short time in the lowered position that the ball will have enough time to roll along the ıgth of the arm 20. This can be done by providing a :ing 46 in the connecting rod 32 and a stop 48 in the th of the arm 20. The stop 48 is set to engage the arm at the appropriate height for depositing the ball on : tee 22 and before the pivot point 38 reaches a posi-n 180° removed from that shown in FIG. 1. When the n 20 engages the stop 48, the crank 36 will continue rotate and the spring 46 will expand causing the arm to hesitate and allow the ball 28 enough time to roll to the tee 22. As the crank 36 continues to rotate past : 180° point, the spring 46 will compress a sufficient ıount to push the rod 30 for raising the arm 20 back to : position shown in FIG. 2.

After the completion of one cycle as discussed, a stop located on the crank 36 will trip a limit switch 52 and ıse the motor to shut off automatically. It can also be :n that as the arm 20 is moving downwardly to the sition where the ball 28 is deposited onto the tee 22, : remaining balls will remain in the position shown in : conduit 16 because the forward-most ball will en-ge a back wall 54 of the arm 20 and be prevented ›m moving until the arm 20 is once again in the raised sition at which time the forward-most ball 28 will roll o the arm 20 and the other balls will advance one sition.

In order to allow a golfer to practice chip shots as :ll as tee shots, the arm 22 is provided with a tele-scopic section formed by an outer sleeve 56 and an inner sleeve 58 so that when a set screw 60 is loosened the outer sleeve 56 can be pulled outwardly to lengthen the arm 20 and allow the ball to be deposited beyond the tee 22.

The teeing mechanism can automatically be activated by means of a switch located at various places in the system. For example, a switch could be located in the opening 14 or at any point along the conduit 16 to be activated by a golf ball. An auxiliary manually-operated switch can be located near the tee 22 to allow the golfer merely to touch the switch with his golf club or foot when another ball is desired. These switches could be connected to a coin-operated mechanism so that a golfer could be entitled to receive a predetermined number of balls after depositing one or more coins.

Figure 3:
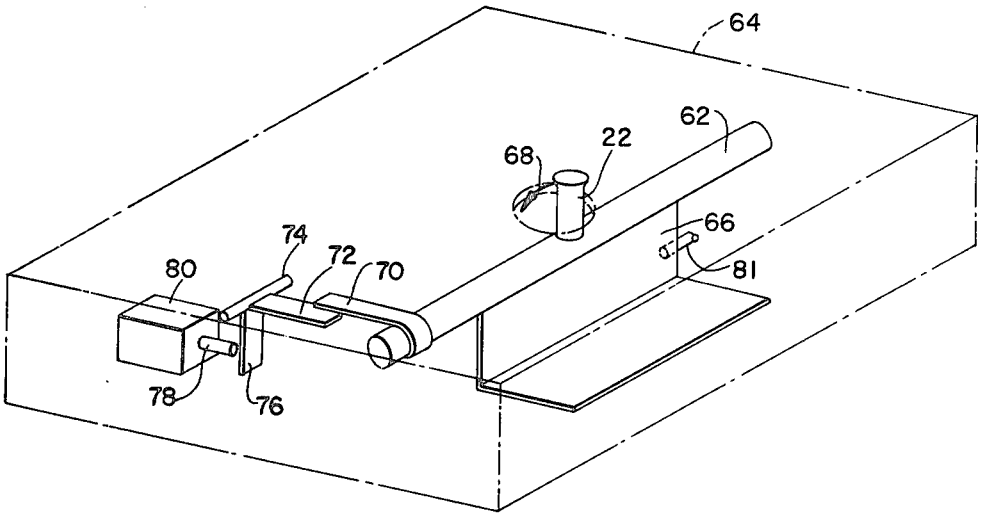
FIG. 3 is a perspective view of a switching devi which operates automatically as a ball is driven frc the tee of the device shown in FIG. 2.

A unique type of switching mechanism, as shown in FIG. 3, can also be provided which automatically tees up another ball as soon as the ball on the tee is driven. As shown in FIG. 3, the tee 22 is rigidly mounted on a rod 62 which is rotatably mounted inside a box designated by reference numeral 64 and shown by the dotted lines. A counterweight 66 is connected along the lower edge of the rod 62 to maintain the tee 22 in the upright position shown in FIG. 3.

When the ball is hit off of the tee 22, the force of the club hitting either the tee or the ball will cause the rod 62 to rotate in the direction of an arrow designated by reference numeral 68 which in turn will cause an arm 70 which is connected to the rod 62 to rotate and engage an L-shaped member 72. The L-shaped member 72 is pivoted about a pin 74 so that the edge of the bottom portion of the "L" will be caused to move and depress a plunger 78 of a limit switch 80 which will close the circuit of the motor and move the arm 20 as discussed above. As soon as the plunger 78 is engaged by the L-shaped member 76, the tee 22 will automatically rotate back to its initial position by means of the counterweight 66 so that the next ball can be deposited onto the tee 22. A stop 81 can be located on the path of the counterweight 66 to prevent the tee 22 from rotating past its normally upright position.

Figure 4:
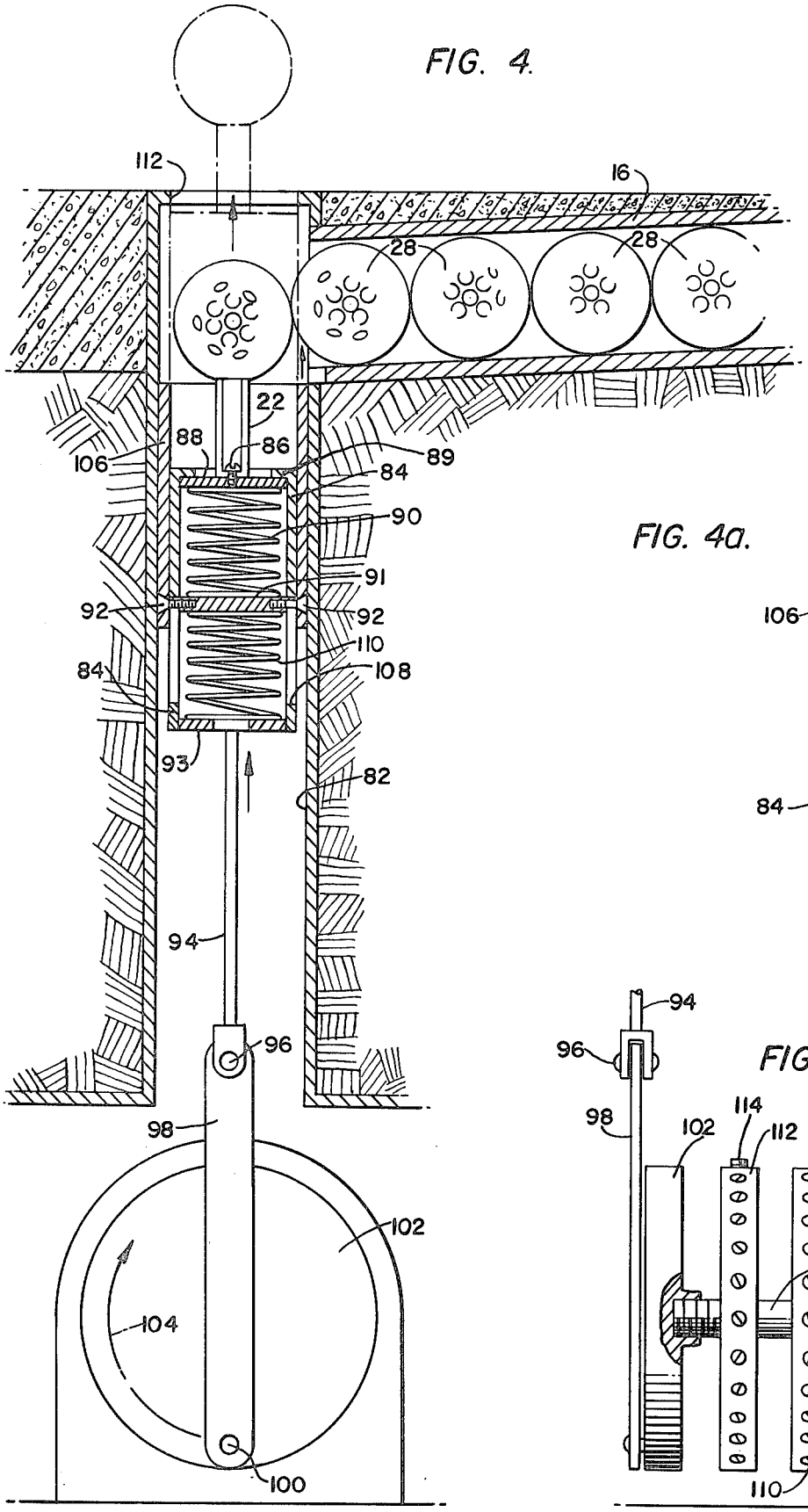
FIG. 4 is a side plan view of an automatic teei device which includes a piston and is recessed benea the driving surface.

In another embodiment of the invention, as shown in FIG. 4, the automatic teeing device can be totally contained beneath the surface of the ground. As shown, the conduit 16 opens into a vertical cylindrical chamber 82 in which a piston 84 is movable up and down. The tee 22 is connected to the upper end of the piston 84 by means of a screw 86. The upper end of the piston 84 is formed of a plug 88 which is held in place by means of a flange 89 located around the upper perimeter of the piston 84 and a spring 90 located inside of the piston. The lower end of the spring 90 bears against a second plug 91 located inside the piston 84, which is held in place by screws 92. The other structure inside the piston 84 will be described below. This spring and plug mechanism will allow the tee 22 to be depressed into the ground when the tee is in its uppermost position projecting out of the ground, should someone step on the tee, thereby preventing the tee and other elements of the device from becoming damaged.

The bottom portion of the piston is formed by a plate 93 to which a rod 94 is connected. The rod 94 is pivotally connected at a pivot point 96 to a connecting rod 98 which in turn is connected at the pivot point 100 to a crank 102 which is mounted on a shaft 103 of a motor such as that described above. The motor will cause the crank 102 to rotate in the direction of an arrow designated by reference numeral 102. When this occurs, the connecting rod 98 will move upwardly which will cause the piston 84 to move upwardly and raise the ball which is on the tee 22 above the surface of the ground.

Figure 4A:
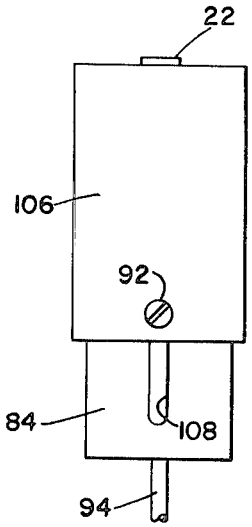
FIG. 4*a* is a front plan view of an outer sleeve for t piston shown in FIG. 4.

In order to prevent the remaining balls 28 in the conduit 16 from interfering with the upward movement of the piston 84, a sleeve 106 is slidably mounted around a portion of the outer surface of the piston 84 and projects above the piston to just below the top of the tee 22. As shown in FIGS. 4 and 4*a*, the piston 84 includes two slots 108 in which the screws 92 can slide for moving the plug 91. A second spring 110 is located inside the piston 84 below the plug 91. A flange 112 is located around the upper periphery of the chamber 82, which projects into the path of the sleeve 106. After the ball 28 is on the tee 22 the piston 84 will move upwardly and carry the sleeve 106 into the path of the balls 28 in the conduit 16. When the sleeve 106 engages the flange 112, the sleeve 22 will stop moving, but the piston 84 will continue to move with the screws 92 sliding along the slots 108. This will cause the plug 91 to move downward relative to the piston 84 and compress the spring 110. The spring 110 will return the plug 91 back to its initial position when the piston 84 again moves downward.

Once the golf ball is driven from the tee 22, the motor can be activated in any suitable way, causing the crank 102 to move in the direction of the arrow 104 and pull the piston 84 downward. When the piston 84 and sleeve 106 once again reach the position shown in FIG. 4, the next forward-most ball will roll out of the conduit 16 and onto the tee 22 and the remaining balls will each move forward one position.

Figure 4B:
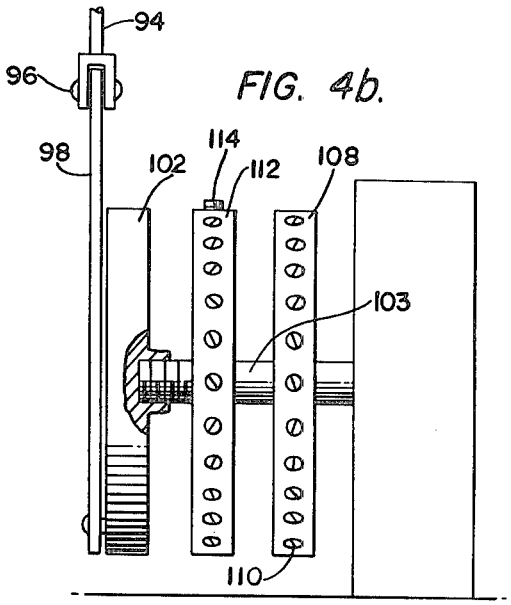
FIG. 4*b* is a front plan view of a crank and indexi mechanism for the teeing device shown in FIG. 4.

The height of the ball above the ground can be regulated by means of indexing stops as shown in FIG. 4*b*, where a cam plate 112 is shown with a series of set screws 114 which can be screwed into or out of the cam plate 112 to trip a limit switch for stopping the motor. A second cam plate 116 with a series of indexing screws 118 is also provided for stopping the mechanism at an appropriate lowered position.

Thus, there is provided in accordance with the invention several alternative automatic teeing devices which quickly and easily tee-up golf balls with no bending required by the player. The arm-type embodiment has advantageous features such as the telescoping arm so that the teeing device can be used both for driving and chip shots and a connecting rod with expansion means therein to allow the arm to remain in a lowered position long enough for the ball to roll onto the tee. The recessed embodiment includes a spring-loaded piston so that should a person step on the tee it will be depressed so that the mechanism will not be damaged or the te broken. Further, the sleeve mechanism which cooper ates with the piston provides an effective way to pre vent other balls in the conduit from interfering with th piston.

It should be understood that those with ordinary skil in the art will be able to make improvements and modi fications to the embodiments described above and tha all such improvements and modifications are contem plated as falling within the scope of the appendec claims.

I claim:

1. An automatic golf ball teeing apparatus, compris ing a chamber located beneath the ground, a pistor movable in said chamber between first and second posi tions vertically relative to said chamber, means fo moving said piston between the first and second posi tions, the piston including first and second movabl means in the piston, the first movable means being lo cated at the top of the piston, first biasing means fo biasing the first movable means upwardly, a tee con nected at the top of the first movable means and project ing outwardy from the top of the piston, the seconc movable means being located along the length of th piston, second biasing means for biasing the seconc movable means upwardly, a sleeve located around th outer surface of the piston and movable relative theret and extending above the piston when the piston is in th lower position, connecting means for connecting th sleeve to the second movable means, an opening in th piston for allowing the connecting means and the sec ond movable means to move relative to the piston, stop means located in the chamber for engaging the sleeve a the piston moves toward the second position for stop ping movement of the sleeve relative to the piston, th second biasing means urging the sleeve back to its initia position as the piston moves toward its first position anc the sleeve disengages from the stop means.

2. The apparatus in claim 1, wherein the first anc second biasing means include coil springs.

3. The apparatus in claim 1, wherein the means fo moving includes a rod and crank mechanism.

4. The apparatus in claim 1, wherein the stop mean includes an inwardly projecting flange located at th upper periphery of the chamber.

5. The apparatus in claim 1, wherein the opening includes a pair of slots located along the length of th piston.

6. The apparatus in claim 1, wherein the first biasing means includes a spring located between the first anc second movable members.

* * * * *